United States Patent [19]

Talbert et al.

[11] 4,086,675

[45] May 2, 1978

[54] REINFORCED EDGE CONSTRUCTION FOR CUSHIONS

[75] Inventors: Miles E. Talbert, Trinity; James R. Walsh, Thomasville, both of N.C.

[73] Assignee: Thomasville Products, Inc., High Point, N.C.

[21] Appl. No.: 756,755

[22] Filed: Jan. 5, 1977

[51] Int. Cl.[2] ..... A47C 27/08

[52] U.S. Cl. ..... 5/355; 5/361 B; 5/345 R; 297/DIG. 1

[58] Field of Search ..... 5/345 R, 351, 355, 361 B; 297/DIG. 1, 2

[56] References Cited

U.S. PATENT DOCUMENTS

| | | | |
|---|---|---|---|
| 3,308,491 | 3/1967 | Spence | 5/355 |
| 3,452,127 | 6/1969 | Lovetti et al. | 5/351 |
| 3,459,611 | 8/1969 | Joseph et al. | 5/351 |
| 3,526,912 | 9/1970 | Lerman | 5/355 |
| 3,939,508 | 2/1976 | Hall et al. | 5/345 R |

*Primary Examiner*—Casmir A. Nunberg

[57] ABSTRACT

A cushion construction having a central area formed of a flexible foam material exhibiting a 25% ILD in the range of 10–50 pounds and a surrounding outer band or border of rebonded foam material exhibiting a 25% ILD in the range of 50–200 pounds. The outer band extends around and is bonded or secured to the side walls of the central area and thereby supports the edges of the cushion to prevent edge collapse or "rollover".

3 Claims, 1 Drawing Figure

REINFORCED EDGE CONSTRUCTION FOR CUSHIONS

BACKGROUND OF THE INVENTION

A substantial percentage of the mattresses produced in the United States today, and an even larger percentage of the cushions and paddings utilized in the furniture industry are constructed from flexible foam materials. The manufacturers of these foam products have invested large sums of money and time in research to improve the quality and performance of their products and have had considerable success in controlling such characteristics as firmness values, densities, life expectancy etc. of the mattresses and cushions which reach the consumer. For example see U.S. Pat. No. 3,939,508 to Hall et al.

Because of the nature of the foam materials used in this industry, however, there remains a problem with maintaining the conformation and structural quality of the edges and corners of the cushions and mattresses. The term "rollover" is commonly used in the industry to define a deformed condition caused by a permanent collapse or sagging of the edges and corners of cushions which frequently occurs after a period of use. Such collapse or "rollover" usually increases with age and use of the product and is both unsightly and uncomfortable to sit or lie upon. When edge collapse occurs on upholstered furniture cushions, it will create extra wear on upholstery fabrics and cause it to stretch or pull, and ultimately tear. When the process occurs on mattresses, the appearance is poor but most importantly, can create discomfort and problems with sleeping. The answer, unfortunately, is not merely to make the cushion of a firmer foam, because then comfort is sacrificed.

While considerable effort and some success has been achieved in inner spring type mattresses and cushions, to the knowledge of the applicant there has been no success in prior attempts to reinforce the corners and edges of foam mattresses or cushions to prevent the occurrence of rollover after periods of use.

SUMMARY OF THE PRESENT INVENTION

With the aforementioned problems in mind, the present invention is directed to a cushion or mattress construction wherein the edges and corners, only, are reinforced to prevent rollover. Within the teachings of the present invention, the construction technique employs a relatively soft central area or base of flexible foam material of a firmness in the normal comfort range. A significantly firmer continuous outer band or border of reground, bonded flexible foam material is bonded around the side walls of the central area. It is essential that the outer band have a firmness value which is sufficient to support and reinforce the edges and corners of the cushion.

Firmness is normally measured in terms of a "25% ILD range" which is the range of force or weight applied through a 50 square inch plate to compress a precrushed 20×20×4 inch specimen to 25% of its thickness. "ILD" is an abbreviation for "indent load depression".

The outer band of applicant's invention must be substantially firmer than the inner core, or it will do nothing to support the corners of the cushion construction. It has been established by the applicant that a cushion is comfortable if the central area exhibits a 25% ILD value in the range of 10 to 50 pounds. Further it has been found by the applicant that rollover can be eliminated or minimized if the outer band exhibits a 25% ILD value in the range of 50 to 200 pounds. It has also been established that these values are easier to control when a combination of differing types of foam products are used for the construction.

The materials used may be any of the known flexible foam products such as polyurethane. For the central area a virgin foam material is used which has been molded, or cut from existing slab stock, to the size and shape desired. For the outer border, it is preferable to use a continuous band or strip of flexible material made from reground and bonded foam chips. These sheets are made from flakes, chips, etc. of scrap virgin foam which are compressed and bonded together in sheet form by the use of heat and/or adhesives. Generally the more material which is compressed, the higher the resulting firmness value of the foam sheet.

When the sheet of rebonded foam has been cut to the proper dimension for positioning continuously around the side walls of the central area, it is then glued, fused, or otherwise bonded to the side walls. Alternatively this band could be poured and molded into place around the inner area, but the production costs involved with such an approach would increase considerably.

The aforementioned higher firmness or ILD value of the outer band is essential to the present invention in that the area adjacent the edge must exhibit sufficient firmness to support the corners and edges of the finished product, while the central area must be softer for comfort consideration.

The relationship between the firmness of the large central area and the relative thin outer band may be varied depending on the ultimate end use of the product and the individual comfort desires of the customers. Additionally, the thickness of the outer band may be varied if desired to increase the support as for example, using a greater thickness for the outer band around the sides of a mattress where the central area to be supported is greater. A thinner band would be preferable around a seat cushion so that the comfort of the softer inner portion is not lessened.

It is therefore an object of the present invention to provide a foam cushion and mattress construction wherein the central area is formed of material exhibiting a comfortable firmness, while edges and corners thereof are formed of a substantially firmer material to prevent rollover.

Further objects and advantages of the invention will be apparent to those skilled in the art when the following detailed description is studied in conjunction with the following drawings of which:

FIG. 1 is a perspective view, with a portion of an end cut away from the top and side, of a mattress constructed according to the present invention.

DETAILED DESCRIPTION OF THE PREFERRED EMBODIMENT

Figure 1:
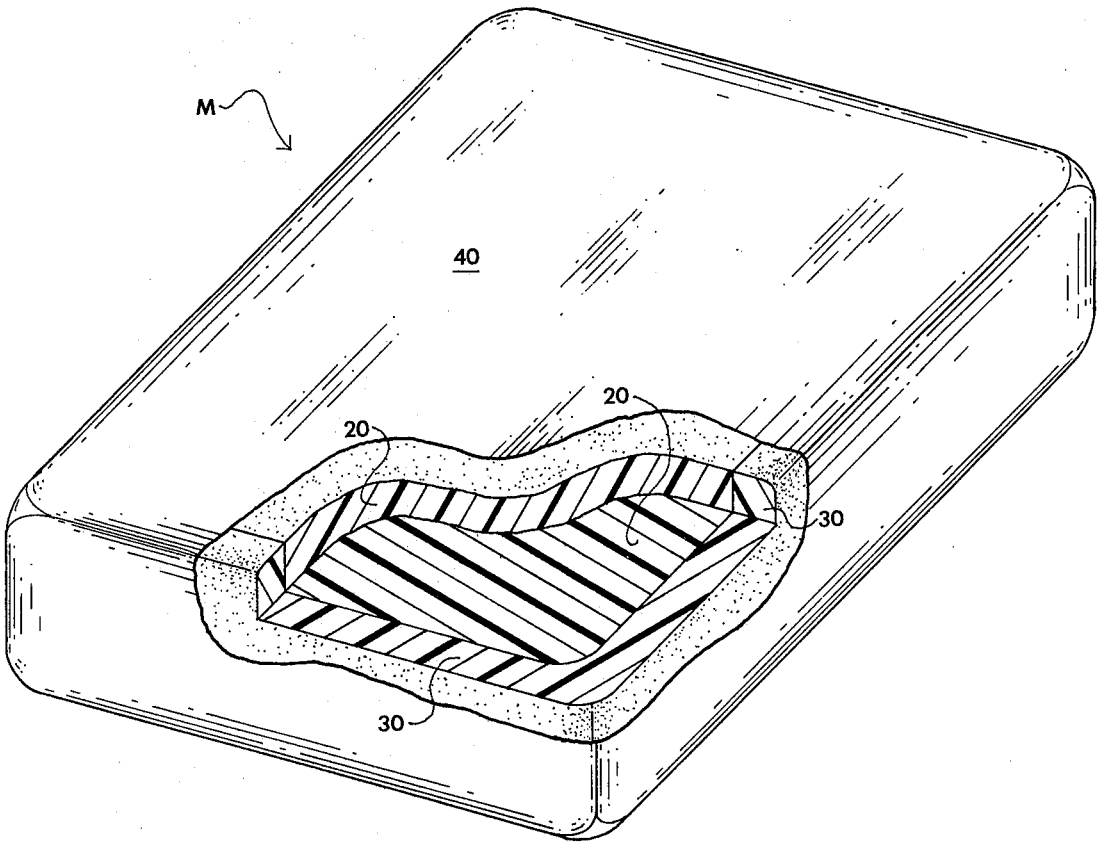

The cushion or mattress construction M as illustrated in FIG. 1 includes a central portion or area 20 and a continuous outer band 30 surrounding area 20, both made from flexible foam materials. A covering 40 encases the construction M and is made from fabrics such as conventional upholstery materials or mattress ticking.

In the preferred construction of cushion M, the inner core 20 is cut to desired size and shape from slab stock and preferably virgin foam material, or possibly from a laminate such as described in U.S. Pat. No. 3,939,508. It is generally more economical to cut from slab stock foam because furniture cushions and mattresses are most often rectangular in shape and slab stock foam material may be easily cut into rectangular shapes of desired size and thickness. Alternatively the inner core 20 may be molded in a desired configuration.

Use of virgin foam material or said laminate for the central area is preferred because of its comfort characteristics. This material should preferably exhibit a 25% ILD in the range of 10–50 pounds with a density range of 1–3.5 pounds/cubic feet. The virgin foam may be economically produced with softer, lower firmness values for furniture cushions, or with firmer intermediate firmness values for mattresses.

The next step in construction of cushion M is the application of the outer band 30 around the side walls of the inner core 20. The band 30, as discussed hereinabove, is preferably constructed from a strip of flexible foam material made from scrap chips and flakes of foam which have been compressed and bonded together using heat and/or adhesive. Such material should exhibit a 25% ILD in the range of 50–200 pounds and have a density of 3–10 pounds/cubic feet. Also, as previously discussed herein, the strips of rebonded foam which are used to make the band 30 may be of any desired thickness depending on usage, but will generally be in the range of from one inch to six inches in thickness, with the thinner strips most often used for furniture cushions.

The length of the outer band 30 which is cut from the aforementioned foam sheets is determined by and equal to the circumference or perimeter around the side walls of central area 20, and the width of the band 20 is, in substantially all cases, equal to the height of the side walls of the central area. The band should then be positioned around the side walls of central area 20 such that the ends will abut and finish into a smooth, closed seam when the band 30 is laminated by heat or adhesive. The top and bottom surfaces of the central area 20 will then be flush or coplanar with the respective edges of the band.

After the band is laminated to the cushion M, an upholstery covering 40 or mattress ticking is applied overall. The covering 40 may be permanently applied by sewing or removably emplaced around the cushion structure with no necessity for laminating to prevent its pulling and stretching due to corner and edge collapse of the central area.

In the preferred embodiment of the instant invention discussed hereinabove the strip 30 is separately formed then bonded to the edges of central area 20. Alternatively the border 30 could be molded around the central area 20, it only being necessary that the edge portion be of sufficient firmness to prevent rollover and the central area be sufficiently soft for comfort reasons. Various modifications may be made without departing from the scope of the invention as defined in the following claims.

What is claimed is:

1. An improved, all foam, cushion construction comprising a central area of flexible foam sheet material of a prescribed thickness and having length and width dimensions forming a perimeter defining upper and lower surfaces with intermediate side walls; a continuous outer band flexible foam material extending around and bonded to said side walls of said inner core; said outer band exhibiting substantially firmer characteristics than said central area to reinforce and stiffen the corners of the cushion to prevent edge collapse, said central area exhibiting a 25% ILD of no greater than 50 pounds and said outer band exhibitng a 25% ILD of at least 50 pounds.

2. The cushion construction according to claim 1 wherein said central area exhibits a 25% ILD in the range of 10 to 50 pounds and said outer band exhibits a 25% ILD in the range of 50 to 200 pounds.

3. The cushion construction according to claim 1 wherein said central area is formed of virgin foam and said outer band is formed of reground, bonded flexible foam pieces.

* * * * *